US006440043B1

(12) United States Patent
LaCoste

(10) Patent No.: US 6,440,043 B1
(45) Date of Patent: Aug. 27, 2002

(54) LENGTH ADJUSTABLE JUMP ROPE APPARATUS

(76) Inventor: Marvin LaCoste, P.O. Box 292, Kiln, MS (US) 39556

( * ) Notice: Subject to any disclaimer, the term of this patent is extended or adjusted under 35 U.S.C. 154(b) by 10 days.

(21) Appl. No.: 09/637,091

(22) Filed: Aug. 10, 2000

(51) Int. Cl.[7] ..... A63B 5/20
(52) U.S. Cl. ..... 482/82; 482/82
(58) Field of Search ..... 482/81, 82, 908, 482/110, 114, 116, 120

(56) References Cited

U.S. PATENT DOCUMENTS 2,723,121 A * 11/1955 Cartwright et al. ..... 482/82

* cited by examiner

*Primary Examiner*—Jerome W. Donnelly
*Assistant Examiner*—Tam Nguyen
(74) *Attorney, Agent, or Firm*—Garvey, Smith, Nehrbass & Doody, LLC; Gregory C. Smith

(57) ABSTRACT

A jump rope combination, which includes a single length of jump rope being sufficiently long to allow a large adult to use, a handle detachably secured to each end of the length of rope, each handle comprising a body portion for gripping by the hand, a bore in the body portion for threading each end of the rope therethrough to a desired length, and a continuous channel formed in the outer wall of the body portion for allowing the excess length of rope extending from the handle to be secured within the continuous channel, so that the body may be gripped. In a second embodiment, the rope includes conventional handles having a continuous channel in the handles for allowing excess rope to reside in the channels for determining the various lengths of the jump rope.

10 Claims, 3 Drawing Sheets

LENGTH ADJUSTABLE JUMP ROPE APPARATUS

CROSS-REFERENCE TO RELATED APPLICATIONS

Not applicable

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The apparatus of the present invention relates to jump ropes. More particularly, the present invention relates to an improved jump rope having the ability to be adjustable in its length as to be used by people of various heights.

2. General Background of the Invention

In the field of sports, one of the most common individual pastimes for children and exercise regimen for adults is jumping rope. The conventional jump rope includes a single length of rope, with gripable handle members secured to each end of the rope, so that a person would hold each handle and would commence to jumping rope. In this conventional configuration, the jump rope is usually at a single predetermined length depending on the size of the user. However, because people who jump rope include very small children and sometimes, very tall adults, it would be beneficial to provide a jump rope which would have somewhat conventional features, yet would have the ability to be extended between multiple lengths, beginning with a very small child to a very tall adult, without having to interchange ropes in the process.

BRIEF SUMMARY OF THE INVENTION

The apparatus of the present invention solves the problems in the art in a simple, and straightforward manner. What is provided is a jump rope combination, which includes a single length of jump rope being sufficiently long to allow a large adult to use, a handle detachably secured to each end of the length of rope, each handle comprising a body portion for gripping by the hand, a bore in the body portion for threading each end of the rope therethrough to a desired length, and a continuous channel formed in the outer wall of the body portion for allowing the excess length of rope extending from the handle to be secured within the continuous channel, so that the body may be gripped, and the excess length of rope part of the gripable handle.

Therefore, it is a principal object of the present invention to provide an improved jump rope which allows the rope length to be adjustable, so that the jump rope may be used by various sized users;

It is a further object of the present invention to provide a jump rope apparatus which can be adjusted at various lengths, with any excess rope secured within each of the handle portion;

It is still a further object of the present invention to provide a jump rope which can be easily adjusted in length so that children and adults may utilize the jump rope without changing out parts or having more than one rope available.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
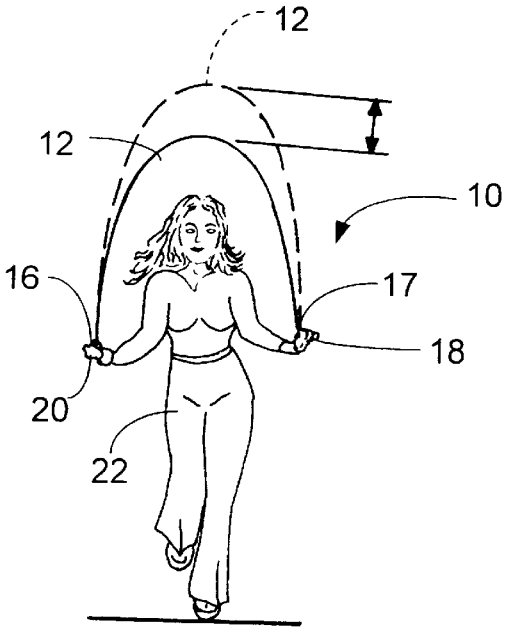
FIG. 1 illustrates the preferred embodiment of the present invention being utilized by a person.

FIGS. 1 through 7 illustrate the preferred embodiment of the present invention by the numeral 10. As illustrated in FIG. 1, improved jump rope 10 comprises a length of rope 12, having a first end 14, and a second end 16. As seen in FIG. 1, the length of rope 12 has a first handle portion 18 secured to end 14 of rope 12, and a second handle portion 20, secured to end 1 6 of rope 12, with each handle portion 18, 20 identical in shape and configuration, and as more clearly seen in FIGS. 2 through 7, to be discussed further. As further illustrated in FIG. 1, the jump rope apparatus 10 is being utilized by a girl 22, holding each ends 14, 16, and swinging the rope 12 above her head, as is typically done while jumping rope. There is also illustrated a second length of rope 12, seen in phantom view, which provides for the ability of the rope 12 to be extendable over various lengths, depending on the size of the user. This ability to be extendable shall be discussed fully below when reference is made to the unique features of each of the handle portions 18, 20.

Figure 2:
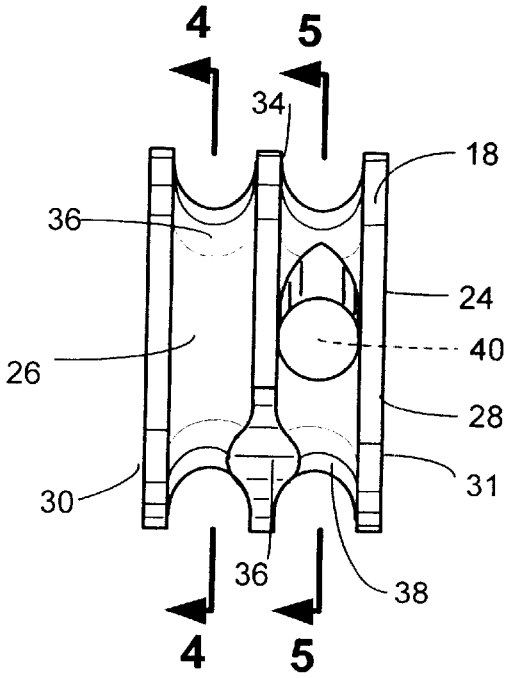
FIGS. 2 and 3 illustrate first and second end views of the handle portion of the present invention.
Figure 4:
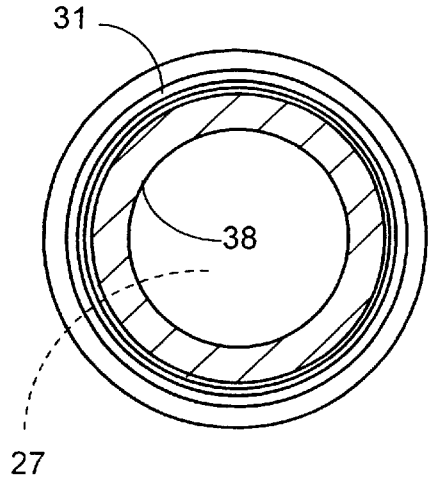
FIG. 4 illustrates a side view of the handle portion of the invention along lines 4—4 in FIG. 2.
Figure 3:
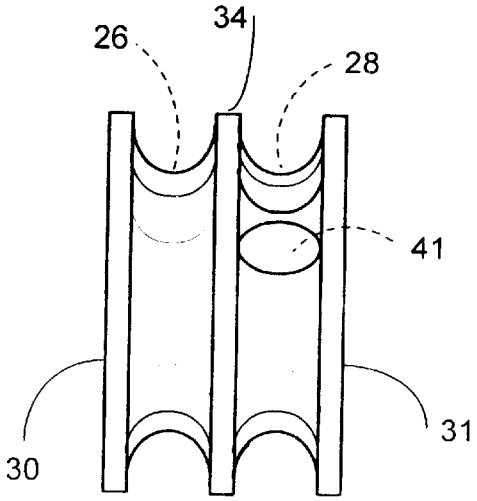
Figure 5:
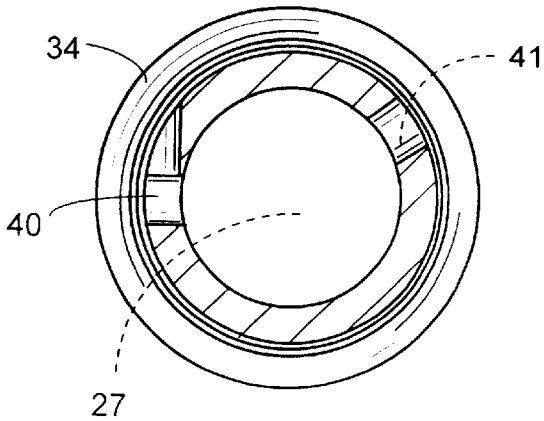
FIG. 5 illustrates a side view of the handle portion of the invention along lines 5—5 in FIG. 2.

For a clear understanding of the construction of handle portions 18,20 reference is made to FIGS. 2 through 5, which illustrate various views of each handle portion 18,20. Turning first to FIG. 2, the first handle 18 is illustrated in overall view. As seen, handle 18 includes a circular body portion 24, formed in a continuous circular member, and having a large bore 27 therethrough. Body portion 24 further defines a pair of channels 26, 28 along its outer circular wall, with each channel having a continuous side wall 30, along the outside of each channel, the side wall 30, being an extension of side wall 31 of the circular body 24. Likewise, as illustrated, the channels 26,28 are separated by a single wall member 34, which helps to define each channel 26, 28 being separate and apart. However as seen further in FIG. 2, the central separating wall 34 becomes discontinuous at a point 36 along its length, so as to allow communication between the two channels 26, 28. Further, the bore 26 is defined by a continuous interior wall 38, which also serves as the floor of each channel 26, 28. In the wall 38, there is formed several bores 40, 41 sufficiently large enough to accommodate a length of the rope 12. These features as seen in the drawings will be fully explained as being essential to the operation of the handle members 18, 20 of the apparatus, and will be discussed further in reference to FIGS. 6 and 7.

Figure 6:
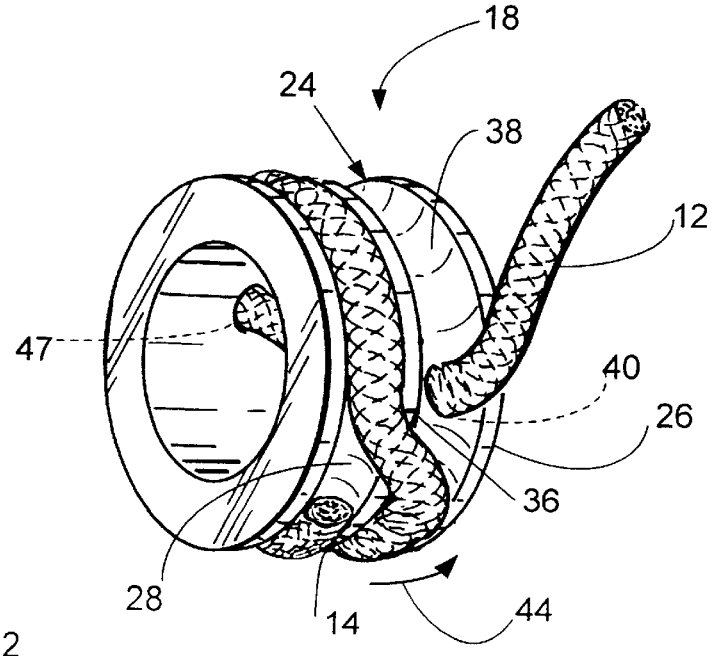
FIGS. 6 and 7 illustrate two overall views of the preferred embodiment of the handle member of the present invention, with a length of rope secured there within.
Figure 7:
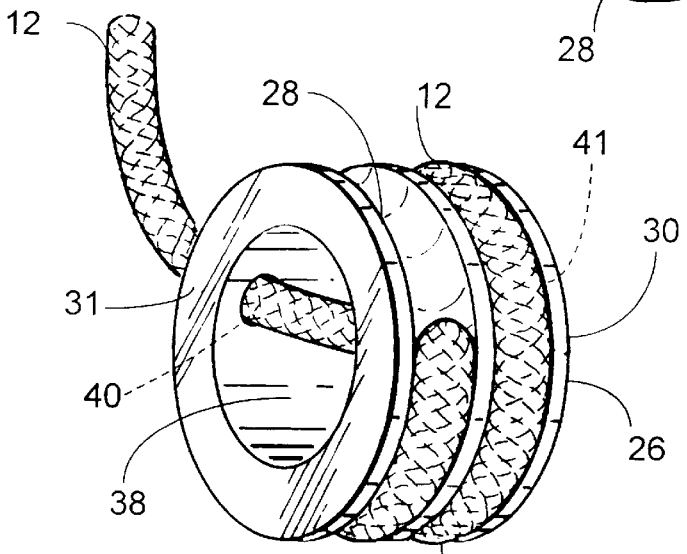

As seen in FIGS. 6 and 7, one of the handle members 18 is illustrated in overall view, with one end 14 of the rope 12 engaged thereupon. As seen, first in FIG. 6, the rope 12 has been threaded through the first bore 40 of the floor 38 of body 24. The end 14 or rope 12 would then be threaded through bore 41 of the body to extend outward into channel 28. The length of rope would then be wound within channel 28, in the direction of arrow 44, until it reached point 36 along wall 34, where the rope would be crossed over, as seen in FIG. 7, into channel 26, where it would also be wound within that channel 26. It is foreseen that the channels 26, 28 would be sufficiently long to accommodate the longest length of excess rope 12, when a very small person is using the apparatus 10. Of course, once the rope 12 is wound within the channels 26,28, the body portion would be gripped by the user, in such a way that the rope is maintained within the channels by the user, and therefore the rope length remains constant, while the rope is held in place.

To more fully explain the apparatus, reference again is made to FIG. 1. As was stated earlier, in that figure a girl 22 is using the jump rope 10, and it is at its desired length, as seen by the unbroken line of rope 12. The ends 16, 18 of the rope 12 are secured within each handle 18, 20 and gripped tightly by the girl 22. Should the girl 22 wish to extend the length of the rope 12, or a taller person want to use the jump rope 10, and increase its length to phantom line 12*a* length, as seen in FIG. 1 all that would be required is that an equal length of rope 12 would be pulled from each handle 18, 20, until the desired length 12*a* is obtained. The handles 18, 20 would be gripped once more, and the jumping could resume.

In the preferred embodiment it is foreseen that the rope 12 would be of sufficient length to accommodate a tall person, e.g. over 6 ft. in height, to a very short person, let's say a child 4 feet in height. The difference in the two heights would be around two feet. Therefore, when the small child is jumping, each handle 18, 20 would have one foot of rope 12 wrapped within channels 26, 28, and when the tallest person is jumping, the extra rope 12 could simply be let out completely, and tied off so that only each of the very ends of the rope 12 is held within each handle. Since the vast majority of users would be within a middle range between these two extremes, it is foreseen that in most cases some length of rope 12 would be wound within channels 26, 28 while the apparatus is in use.

Figure 8:
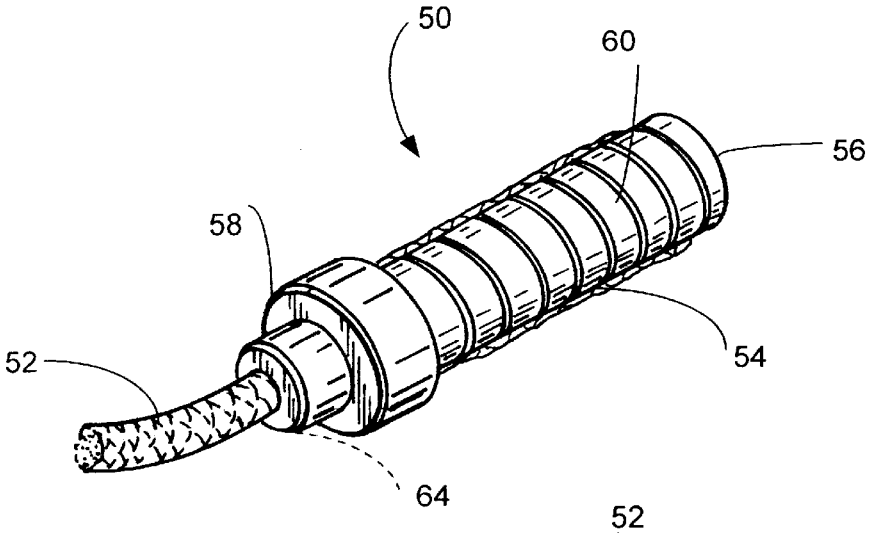
FIGS. 8 through 10 illustrate views of an alternate embodiment of the handle portion of the present invention.
Figure 10:
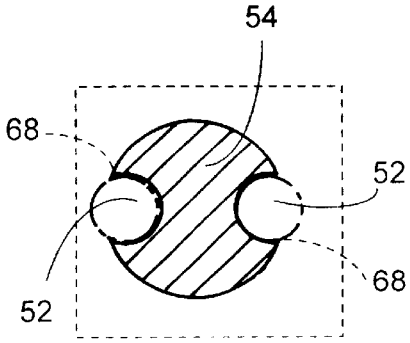
Figure 9:
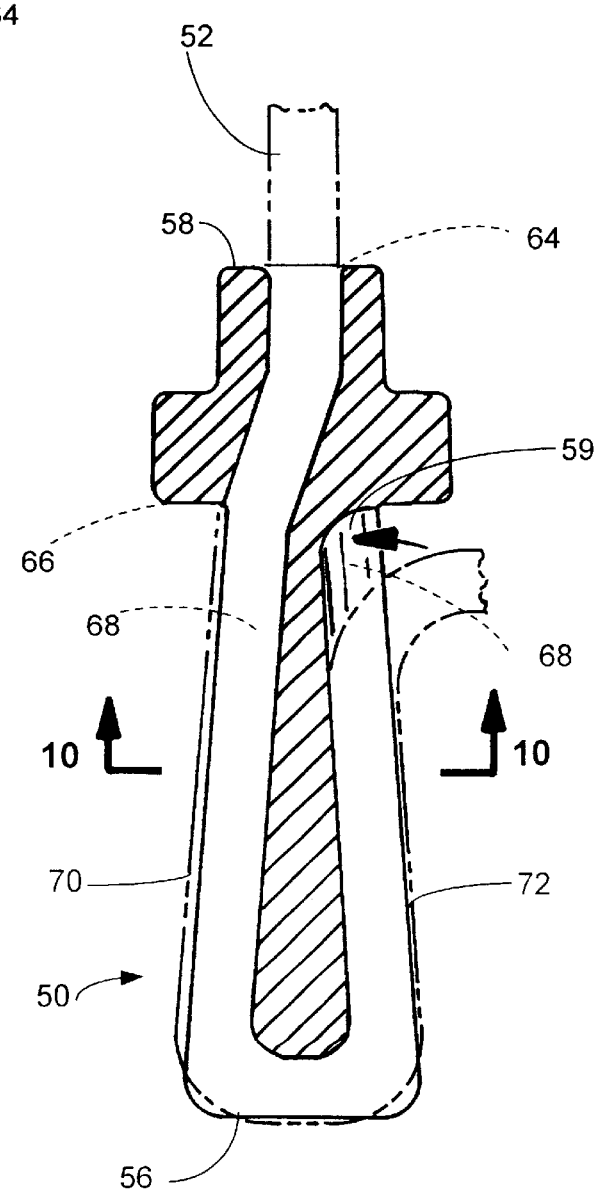

FIGS. 8 through 10 illustrate an additional preferred embodiment of the present invention by the numeral 50. As illustrated the jump rope 50 comprises a length of rope 52, as with the first embodiment described in FIGS. 1 through 7. This embodiment incorporates a new handle 54, on each end of the jump rope 50. As seen in the figures handle 54 comprises a first end portion 56, a second end portion 58, and an elongated grip portion 60 for gripping by the person using the jump rope 50. As with a conventional jump rope handle, the end 62 of the length of rope 52 is threaded into an opening 64 at the second end 58 of handle 54. However, instead of being threaded completely through handle 54, and extending from the first end 56, to be tied off, the opening 64 leads to an exit opening 66 adjacent the second end 58, so that the length of rope extends out of opening 66. At opening 66, there is provided a continuous channel 68 which extends along a first side 70 of handle 54, around the first end 56, and back down the opposite side 72 of handle 54, terminating at channel end 59, as seen in FIG. 9. Channel 68 is sufficiently deep to allow rope 52 to rest therein, and protrude slightly above the face of handle 60, as is illustrated in FIG. 10. That way, when a user of the jump rope 50 grasps the handle 54, the rope will be further compressed into channel 68, holding it firmly in place.

The adjustability of jump rope 52 is provided by the amount of rope 52 one wishes to extend into channel 68. For example, one may wish to have the shortest jump rope 52 possible, therefore, one would fill the entire channel 68 with rope 52 on both handles 60. On the other hand, one may not want any rope at all within channel 68, so rope 52 would be at its greatest length. Finally, rope 52 may be placed at any distance within channels 68 between the minimum and the maximum for a varied lengths of jump rope.

This embodiment provides for a conventional jump rope handle to be modified so that a user may still comfortably use the apparatus, yet have the added feature of having the ability to change the length of the jump rope for various sized individuals.

The foregoing embodiments are presented by way of example only; the scope of the present invention is to be limited only by the following claims.

What is claimed is:

1. An improved jump rope apparatus, comprising:

a) a portion of rope of a maximum determined length and having first and second end portions;

b) first and second handle portions, each first and second handle portions each comprising:

i) a substantially circular body portion;

ii) a pair of channels formed in the body portion;

iii) a bore formed through the body portion for allowing one end of the first and second end portions of equal length of rope to be threaded through each of the first and second body portions for obtaining the desired length of jump rope between each of the body portions, and the first and second end portions of rope wrapped within the channels of each first and second body portions, so that each first and second body portions with the rope wrapped thereupon may be gripped as each first and second handle portions.

2. The apparatus in claim 1, wherein each of the channels are separated by a sidewall, except for an open portion for allowing the length of rope to cross over from the first to the second channel.

3. The apparatus in claim 1, wherein the maximum length of rope would allow the apparatus to be used at varying lengths, the length of the jump rope being reduced by allowing the excess length of rope to be wrapped within the channels of each of the body portions.

4. The apparatus in claim 1, wherein the body portions would be of differing circular sizes so that they could be gripped by different sized users of the jump rope.

5. An improved jump rope apparatus, comprising:

a) a portion of rope of a predetermined length and having first and second end portions;

b) first and second handle portions, each first and second handle portions further comprising:

i) a pair of channels formed in each of the first and second handle portions, said channels defining a continuous channel along the wall of each of the second handle portions;

iii) a bore formed through each of the handle portions for allowing one end of the first and second end portions of rope to be threaded through each of the first and second handle portions for obtaining the desired length of jump rope between each of the handle portions, and the first and second end portions of rope wrapped within the channels of each first and second handle portions, so that each first and second handle portions with the rope wrapped thereupon may be gripped by the user to maintain the lengths of rope within each of the handle portions.

6. The apparatus in claim 5, wherein an equal length of rope would be let out of each of the handle portions when the rope would be used by a larger person.

7. The apparatus in claim 5, wherein each of the first and second body portions would receive an equal length of rope therein.

8. The apparatus in claim 5, wherein each of the channels would be separated by a sidewall, except for a portion for allowing the length of rope to cross over from the first to the second channel.

9. An improved jump rope apparatus adjustable in length, comprising:

a) a portion of rope of a maximum determined length and having first and second end portions;

b) first and second handle portions, each first and second handle portion comprising a first and second end portion with a gripping portion intermediate the first and second end portions;

c) a channel formed in an exterior wall of each of the first and second end portions for defining a continuous channel along the wall of each of the handle members;

d) each end of the portion of rope threaded through a port in each of the first and second handle portions, with any excess rope capable of residing within the channels formed in the exterior wall of each of the first and second end portions.

10. The apparatus in claim 9, wherein the port through which each of the ends of the rope is threaded has a first opening at the first end of the handle portion and an exit opening on the wall of the handle portion, adjacent the first end of the handle portion, and communicates with the channel.

* * * * *